US005620564A

United States Patent [19]

Akhtar

[11] Patent Number: 5,620,564

[45] Date of Patent: Apr. 15, 1997

[54] METHOD OF ENHANCING BIOPULPING EFFICACY

[75] Inventor: Masood Akhtar, Madison, Wis.

[73] Assignee: Wisconsin Alumni Research Foundation, Madison, Wis.

[21] Appl. No.: 289,479

[22] Filed: Aug. 11, 1994

[51] Int. Cl.[6] ..... D21C 3/00; D21C 3/20

[52] U.S. Cl. ..... 162/72; 162/13; 435/278

[58] Field of Search ..... 162/72, 72 B, 162/13; 435/171, 277, 278, 911

[56] References Cited

U.S. PATENT DOCUMENTS

| | | | |
|---|---|---|---|
| 4,225,381 | 9/1980 | Ishikawa et al. | 162/51 |
| 4,655,926 | 4/1987 | Chang et al. | 162/29 |
| 5,055,159 | 10/1991 | Blanchette et al. | 162/72 |

OTHER PUBLICATIONS

Akamatsu, et al, "Influence of White Rot Fungi on Poplar Chips and ThermoMechanical Pulp of Fungi Treated Chips" Journal of Japan Wood Research Society 30(8) pp. 697–702, 1984.

Eriksson et al "Properties of Pulp from thermomechanical pulping of chips pretreated with fungi" Svensk Papper. No. 6, 1982, R33–R38.

Setliff et al. "Biomechanical Pulping with White Rot Fungi" TAPPI, pp. 141–147, Aug. 1990.

Akhtar, et al., "Biomechanical Pulping of Loblolly Pine Chips with Selected White–Rot Fungi," Holzforchung 47:36–40, 1993.

Akhtar, et al., "Biomechanical pulping of loblolly pine with different strains of the white–rot fungus *Ceriporiopsis subvermispora*,"*TAPPI J.* 75:105–109 (1992).

Lamar and Dietrich, "In Situ Depletion of Pentachlorophenol from Contaminated Soil by *Phanerochaete* spp.," *Applied and Environmental Microbiology*, p. 56:3093–3100, 1990.

Leatham, et al., "Biomechanical pulping of aspen chips: energy savings resulting from different fungal treatments," *TAPPI J.*, 197–200, May 1990.

Myers, et al., "Fungal pretreatment of aspen chips improves strength of refiner mechanical pulp," *TAPPI J.*, 105–108, May 1988.

*Primary Examiner*—Karen M. Hastings
*Attorney, Agent, or Firm*—Quarles & Brady

[57] ABSTRACT

A method of making a wood pulp is disclosed. The method includes chipping wood into wood chips and then inoculating the wood chips with an inoculum of *Ceriporiopsis subvermispora* and a nutrient adjuvant selected from the group consisting of corn steep liquor, molasses and yeast extract. The wood chips are introduced into a bioreactor and incubated. The incubated wood chips are then pulped. A method of pretreating wood including chipping the wood into wood chips and inoculating the wood chips with an inoculant of *Ceriporiopsis subvermispora* and a nutrient adjuvant of corn steep liquor is also disclosed. A method for producing paper from the treated wood chips is also disclosed. The addition of the corn steep liquor nutrient adjuvant dramatically reduces the amount of fungal inoculant needed (by multiple orders of magnitude), to achieve similar results.

13 Claims, 1 Drawing Sheet

METHOD OF ENHANCING BIOPULPING EFFICACY

FIELD OF THE INVENTION

In general, the field of the present invention is the biopulping of wood. In particular, the field of the present invention is biopulping of wood with *Ceriporiopsis subvermispora* and a nutrient adjuvant.

BACKGROUND

In the manufacture of paper from wood, the wood is first reduced to an intermediate stage in which wood fibers are separated from their natural environment and transformed into pulp, a viscous liquid suspension. Several techniques are used to produce pulp from various types of wood. The simplest of these techniques is the refiner mechanical pulping (RMP) method, in which the input wood is simply ground or abraded in water through a mechanical milling operation until the fibers are of a defined desired state of freeness from each other. Other pulping methodologies include thermo-mechanical pulping (TMP), chemical treatment with thermo-mechanical pulping (CTMP), chemi-mechanical pulping (CMP) and the chemical pulping, sulfate (kraft) or sulfite processes for pulping wood. The general concept in all of these processes for creating pulp from wood is to separate the wood fibers to a desired level of freeness from the complex matrix in which they are embedded in the native wood.

Of the various components of wood, cellulose polymers are the most abundant and are the predominate molecule desired for retention in pulp for paper production. The second most abundant polymer in wood, which is the least desirable component in the pulp, is lignin. Lignin is a complex macromolecule of aromatic units with several different types of interunit linkages. In the native wood, lignin physically protects the cellulose polysaccharides in complexes known as lignocellulosics. In chemical pulping processes, lignin is removed. In chemi-mechanical processes, lignin is disrupted to free the cellulose or to make it easier to mechanically free the cellulose.

Biological systems can be utilized to assist wood pulping. A desirable biological system would liberate cellulose fibers from the lignin matrix by taking advantage of the natural abilities of an organism. Research in this area has focused on white-rot fungi, so named because the characteristic appearance of infected wood is a pale color. This color is the result of the depletion of lignin in the wood, the lignin having been degraded or modified by the fungi. Because white-rot fungi appear to preferentially degrade or modify lignin, it is a logical choice for biological treatment to pulp wood. Pulping by this method is referred to as "biopulping."

Several attempts to create biopulping systems using white-rot fungi on a variety of wood fibers have been reported. The most commonly utilized fungus is the white-rot fungus *Phanerochaete chrysosporium*, also referred to as *Sporotrichum pulverulentum*. Other fungi which have been previously used in such procedures include fungi of the genera Polyporus and Phlebia. The prior art is generally cognizant of the fact that attempts have been made to use microorganisms, such as white-rot fungi, as part of a process of treating wood in combination with a step of either mechanical or thermo-mechanical pulping of cellulose fiber.

Another example is U.S. Pat. No. 3,962,033, directed to the biopulping of cellulose using white-rot fungi. The fungi used included both naturally occurring wild-type strain cultures and mutant strains produced which lacked cellulase, so as to reduce the amount of cellulose degraded by the organisms. Various types of wood were degraded with the fungi. This wood was then used as input materials for a thermo-chemical or thermo-mechanical pulping procedure. This patent discloses various techniques for making a cellulose pulp by depleting lignin while reducing the cellulose-decomposing action of the enzymes produced by these organisms in order to preserve the cellulose yield. Groups working with the inventor of this patent have several publications regarding use of fungi for biomechanical pulping, e.g. Anders and Erikkson, *Svensk Papperstidning*, 18:641-2 (1975), Erikkson and Vallander, *Svensk Papperstidning*, 6:85:33-38 (1982).

U.S. Pat. No. 5,055,159 discloses biopulping with *Ceriporiopsis subvermispora*. Biomechanical pulping of both hardwood and softwood chips with this white-rot fungus has been demonstrated. During this process at a laboratory scale, fungal pretreatment of both hardwood and softwood species saves substantial amounts of the electrical energy during refining, improve paper strength, and reduce the environmental impact of pulping (Akhtar, et al., "Biomechanical pulping of loblolly pine with different strains of the white-rot fungus *Ceriporiopsis subvermispora*," *Tappi J.* 75:105-109, 1992; Akhtar, et al., "Biomechanical pulping of loblolly pine chips with selected white-rot fungi," Holzforschung 47:36-40, 1993; Akhtar, et al., "Biomechanical pulping of aspen wood chips with three strains of *Ceriporiopsis subvermispora*," Holzforschung 48:199-202, 1994; Kirk et al., "Biopulping: A Glimpse of the Future?", *Res. Rep. FPL-RP*-523, Madison, Wis. pp. 74, 1993). These results show the technical feasibility of biopulping.

One of the key factors determining the commercial and economic feasibility of biopulping is the cost of the fungal inoculum and the related question of culture time of the organism in the wood. Commercial considerations impose a particular time frame on the amount of time, referred to as the dwell time, that can be dedicated to permitting the biopulping fungus to propagate in the wood. One solution to the problem of obtaining sufficient fungal action prior to pulping is to simply add more fungal inoculum. However, the process soon becomes cost prohibitive, if an excessive amount of fungal biomass is needed. Therefore, the art needs a method to reduce the quantity of fungal inoculum needed for successful biopulping in a time scale suitable for commercial application.

SUMMARY OF THE INVENTION

The present invention is a method of making a wood pulp. The method comprises inoculating wood chips with an inoculum of *Ceriporiopsis subvermispora* and a nutrient adjuvant. The nutrient adjuvant is selected from the group consisting of corn steep liquor, molasses and yeast extract. The wood chips are introduced into a bioreactor either before or after inoculation and incubated under conditions favoring the propagation of the fungus. After a sufficient amount of time the fungus modifies a significant amount of lignin naturally present in the wood chips. The chips are then pulped.

In another embodiment of the present invention, paper is made from the pulped chips. In yet another embodiment, the invention is the inoculated wood chips.

In a preferred embodiment of the present invention, between 0.5% and 3% nutrient adjuvant (on a weight basis as a proportion of the wood chip mixture) is used. In another preferred form of the invention, the nutrient adjuvant is corn steep liquor.

It is an advantage of the present invention that wood is biopulped using a smaller amount of fungal inoculant. Preferably, the amount of inoculant is less than 0.3% on a dry weight basis of the total inoculated wood chip mixture. More preferably the amount of the inoculant is less than 0.1% on a dry weight basis. Most preferably, the amount of inoculant is less than 0.0005% on a dry weight basis.

It is an advantage of the present invention that corn steep liquor, molasses or yeast extract may be used as a nutrient adjuvant in a biopulping process.

It is a feature of the present invention that a dramatic reduction in amount of inoculum needed to successfully biopulp wood is enabled.

Other features, advantages and objects will become apparent upon review of the specification, claims and drawing.

DESCRIPTION OF THE INVENTION

Figure 1:
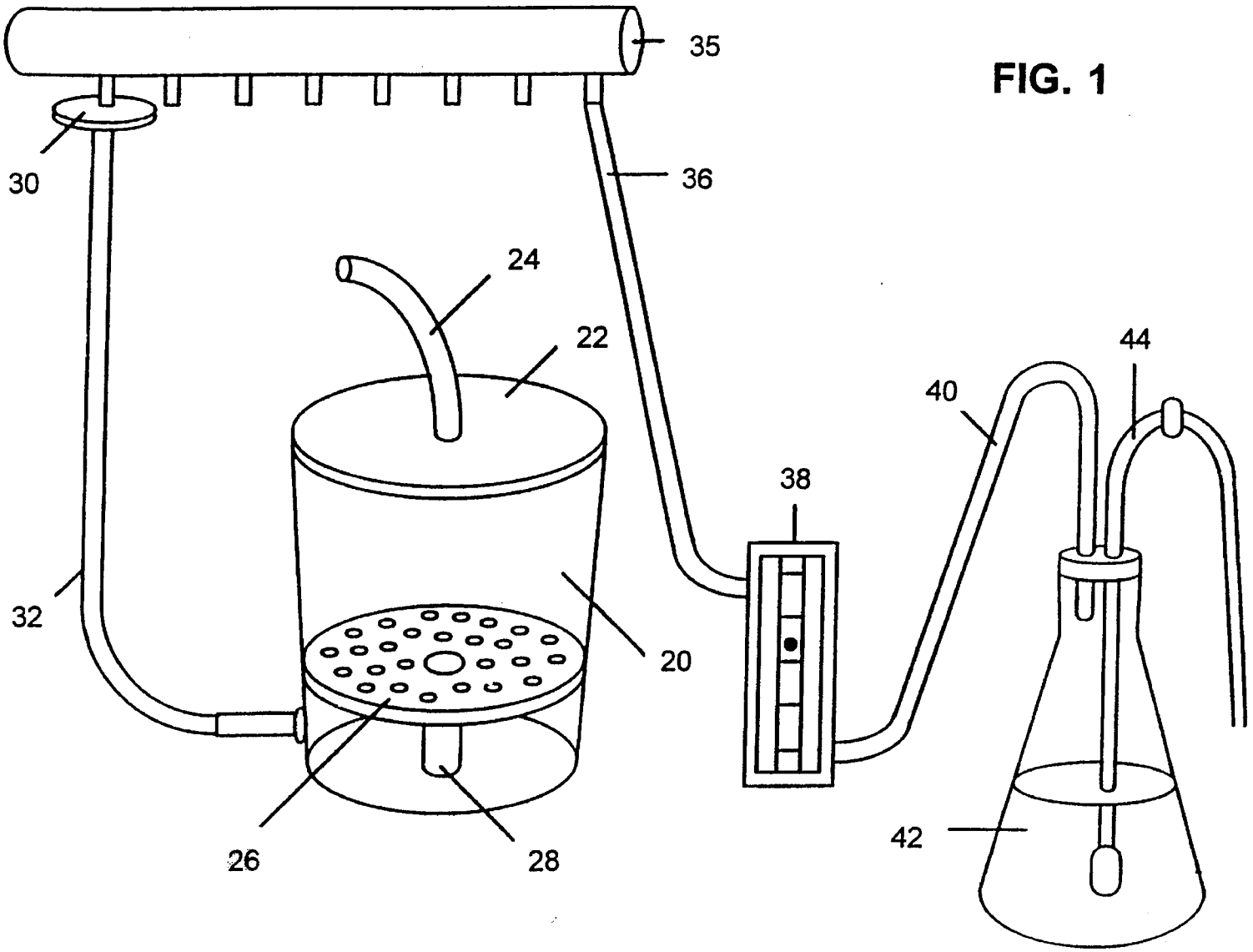
FIG. 1 illustrates the laboratory scale bioreactor used in the illustrative Examples of the present invention.

The present invention is a method of biopulping using a combination of *Ceriporiopsis subvermispora* and a nutrient adjuvant to inoculate wood chips. Use of a nutrient adjuvant, as described below, enables one to dramatically decrease the amount of fungal inoculum (calculated on a dry weight basis as a proportion of the amount of wood chips) from 0.3% to 0.0005% while achieving comparable efficacy. This 600-fold reduction in the amount of inoculum is important in making biopulping technology economically feasible.

1. Wood Preparation

The process begins with wood chips. The process of the present invention was developed with and is particularly useful for the biopulping of softwoods, such as U.S. southern pine species. A preferred species for use in the biopulping process of the present invention is Loblolly pine, *Pinus taeda,* which is a major pulpwood species. The Examples below focus on the use of Loblolly pine. However, the Examples below disclose the success of the present invention with both pine and aspen chips. Example 5, below, discloses the success of aspen chips in the present invention. The present invention has utility for other softwood species and hardwood species as well. The efficacy of biopulping with both softwood and hardwood has been demonstrated in the art.

The wood is converted to chips through a conventional technology to a preferable chip size of anywhere between ⅛ and ¾ of an inch.

Because conditions of high humidity during the fermentation process will be desired, a relatively high moisture content of the chips prior to fermentation with the biopulping fungus is most desirable. Therefore, the chip moisture content prior to inoculation is preferably at the fiber saturation point or greater. A preferred moisture content would be approximately 55–65% of the total wood. This measurement indicates that of the total weight of the moist wood, approximately 55–65% of that weight is moisture.

2. Fungi Application

Separately from the chips, a seed inoculum must be maintained of the fungal culture to be utilized during the biopulping process. The preferred culture is any useful strain of the fungal species *Ceriporiopsis subvermispora,* with one preferred strain being strain CZ-3 available from the Center for Forest Mycology Research of the Forest Products Laboratory, U.S. Department of Agriculture. However, almost all other strains of *Ceriporiopsis subvermispora* are also suitable for the present invention. Other preferred strains are the haploid *Ceriporiopsis subvermispora* strains FP-105752 SS-4, L-14807 SS-1, L-14807 SS-3, L-14807 SS-S, and L-14807 SS-10 which are also obtainable from the Center for Forest Mycology Research, USDA Forest Products Laboratory, Madison, Wis. (Our experiments below demonstrate that two of the haploid strains gave more energy savings and strength improvements than the diploid CZ-3 strain.) *Ceriporiopsis subvermispora* strains are common in the environment and can readily be isolated from the wild.

Strains of *Ceriporiopsis subvermispora* can be maintained by conventional fungal culture techniques, most conveniently by growing on potato dextrose agar (PDA) slants. Stock slants may routinely be prepared from an original culture for routine use and may be refrigerated until used.

The fungal culture may be applied to the wood in several ways. For example, to inoculate significant volumes of wood chips, a starter inoculum may be prepared. The starter inoculum can be simply a smaller volume of chips carrying the fungal mycelium throughout, so that the starter inoculum may be conveniently mixed into a larger volume of chips for the inoculation of the larger quantity of chips. In the starter inoculum culture, a relatively high moisture content in the wood, at least 55%–65% is maintained to ensure better colonization of the chips with the fungal mycelia.

In the laboratory-scale procedures described below, a liquid inoculum is prepared and mixed with the wood chips. The liquid inoculum is prepared by combining potato dextrose broth and yeast extract with distilled water and sterilizing the combined mixture. After cooling to room temperature, the flasks are inoculated with plugs cut from a ten day old potato dextrose agar plate prepared from a working culture of the fungus. These potato dextrose agar plates had been incubated at 27° C. and 65% relative humidity for ten days. The inoculated flasks are then incubated at 27° C. at 65% relative humidity for ten more days.

The flasks are decanted and washed with sterile distilled water to remove the excess medium from the fungal biomass. The fungal biomass is then placed in distilled water and blended in an electric blender twice for 15 seconds at high speed. More distilled water is added to the suspension. An amount of the suspension is dried to determine the dry weight per ml. Different dilutions of the fungal inoculum can then be made from this fungal stock culture to obtain inoculants of different strengths.

The chips are mixed with the liquid inoculum and the mixture is incubated for a time period, preferably between 2 weeks and 4 weeks. Of course, if a commercial scale inoculation is planned, the incubation period may have to be adjusted to meet commercial concerns.

Alternatively, the fungal inoculum may be applied to the wood chips in other ways, such as a liquid spray or a solid inocula.

When the rate of application of the fungal inoculants are discussed here, the inoculum is measured on a dry weight basis. This measurement indicates the percentage of total dry mass of the inoculated wood chips that is represented by the fungal inoculum. For example, a 0.3% inoculum on a dry weight basis means that in 100 g of dry weight of wood chips plus inoculum, 0.3% (0.3 g) of the dry mass is fungus.

Preferably, the fungal inoculant of the present invention is less than 0.3% on a dry weight basis. More preferably, the inoculant is less than 0.1% on a dry weight basis. It has also been found that the fungal inoculant of the present invention can be equal to or even less than 0.0005% on a dry weight basis.

3. Addition of a Nutrient Adjutant

The present invention requires the addition of a nutrient adjuvant to the biopulping procedure described above. Preferably, an amount of the nutrient adjuvant is added to the fungal inoculum prior to the addition of the inoculum to the wood chips. In the Examples below, nutrient adjuvant is added to the inoculum and both inoculum and nutrient are immediately added to the wood chips. However, the nutrient adjuvant could be added separately to the wood chips, before or after the fungal inoculum. Additionally, it is envisioned that it might be advantageous to incubate the nutrient adjuvant and fungal inoculum for a period of time before application to the wood chips.

The nutrient adjuvant of the present invention possesses the capabilities of fostering growth of the fungal biomass in a manner that allows successful biopulping with a limited amount of fungal inoculum. Specifically, the nutrient adjuvant of the present invention will allow at least 100-fold less fungal inoculant to be used for equivalent dwell times to achieve equivalent results. This requirement means that the nutrient adjuvant must possess the appropriate chemical composition to allow the fungal biomass to significantly and dramatically increase its mass relative to a culture growing without a nutrient adjuvant.

Preferably, the nutrient adjuvant of the present invention allows a fungal inoculum of less than 0.1% on a dry weight basis to be used. Most preferably, the nutrient adjuvant of the present invention allows a fungal inoculum of less than or equal to 0.0005% to be used.

As a comparison of Examples 1 and 2 below will demonstrate, a 0.3% fungal inoculum (on a dry weight basis) without a nutrient adjuvant is required for an energy savings of 19% after a 2 week incubation or dwell time. When a 0.001% inoculum (on a dry weight basis) is combined with 1% corn steep liquor (measured as weight of semi-solid liquid as a percentage of dry weight of the wood chips), an identical energy savings of 19% is realized after a 2 week incubation. Therefore, the amount of fungal inocula needed to achieve equivalent energy savings is reduced by at least 300-fold through the use of the adjuvant. Table 2, below at Example 2, indicates that inocula levels of 0.0005% (on a dry weight basis) can be used, thus achieving a significant-economic savings.

Nutrient adjuvants are expressed as percentages on a liquid to dry weight basis. Therefore, a 1% adjuvant solution represents the addition of 1 gram of viscous liquid corn steep liquor to 100 grams of dry weight of the wood. The measurement for yeast extract and molasses additives are expressed as percentages dry weight of dry weight. Since the corn steep liquor is about 50% solids, the additive levels could be reduced by about 50% to obtain dry weight levels for this additive.

Most preferably, the nutrient adjuvant of the present invention is selected from the group consisting of corn steep liquor, molasses and yeast extract. These three components have been found to contain the necessary combination of nutrients to allow the fungal biomass in a biopulping application to increase dramatically. The nutrient adjuvant may be sterilized or autoclaved corn steep liquor, molasses or yeast extract, but sterilization is not required.

The preferable nutrient adjuvant is corn steep liquor. Corn steep liquor is a by-product of the production of corn starch and, as a by-product, is relatively economical. Corn steep liquor is selected because it is relatively cheap ($55/ton of semi-solid liquid in 1994) and is commercially available from Corn Products, a Unit of CPC International Inc., Summit-Argo, Ill.

Corn steep liquor is a condensed fermented corn extractive which is produced in the corn wet milling process when the dry corn is soaked (steeped) in a warm sulfurous acid solution. Corn steep liquor is sold commercially by several companies as a viscous light brown liquid. During the process, the grain solubles are released and undergo a mild lactic acid fermentation from naturally occurring microorganisms. Currently corn steep liquor is used as a liquid supplement for ruminants, unidentified nutrient source for poultry and protein source and biding agent for cattle range blocks.

The composition of corn steep liquor varies slightly. A typical composition is ABOUT as follows:

| | |
|---|---|
| Dry substance (%) | 50.7 |
| pH | 3.9 |
| Protein (% dry basis) | 40.8 |
| Lactic acid (% dry basis) | 16.0 |
| Reducing sugars (% dry basis) | 12.8 |

The Examples below demonstrate the use of a corn steep liquor obtained from Corn Products division of CPC International with the above-identified composition. However, in other experiments, we have used corn steep liquors obtained from other batches, and our results were similar to those obtained with the batch identified above. In general, in a preferred corn steep liquor, the dry substance will vary from about 50%–55%, the pH will vary from about 3.9–4.2, the protein percent will vary from about 20%–50%, the lactic acid percent will vary from about 15%–20% and the reducing sugars will vary from about 5%–15%.

Yeast extract and molasses are also preferred fungal nutrients in the method of the present invention. Yeast extract is commercially available from several commercial sources, one being Universal Foods. Yeast extract is supplied as a powder, spray-dried from a water soluble brewers yeast extract produced by the autolytic action of yeast proteases. Generally yeast extract is sold in powdered dry form. It is usually over 40% protein, with free amino acids, vitamins and minerals.

Molasses suitable for the present invention is any commercially or privately available molasses. Molasses is understood to be residual sugar syrups from which no crystalline sugar can be obtained by simple means.

Preferably, between 0.5% and 3.0% (on a weight to weight basis) nutrient adjuvant is used. On a cost basis, it is advantageous to use as little nutrient as possible. However, this savings has to be weighed against an increase in fungal biomass when increased amount of nutrient adjuvant is used. We envision that nutrient adjuvant between 0.25% and 6%, on a weight to weight basis, will be successful.

4. Incubation of Wood Chips

The actual incubation of the wood chips for fungal degradation may now proceed. Wood chips combined with both the fungal inoculant and nutrient adjuvant are placed in the fermentation reactor (bioreactor). The bioreactor may be any of a number of styles capable of containing solid media fermentation cultures. Though it has been found that rotating drum bioreactors host the fermentation reaction to a sufficient degree, it has also been advantageously found that stationary or static reactors work sufficiently well within the present invention to be preferred. It is merely required that the stationary or solid phase reactor have sufficient aeration so as to ensure adequate oxygen flow to the fungus and significant removal of carbon dioxide therefrom. In fact, it is an advantage of the process described herein that a stationary, and even rudimentary, reactor will suffice. Since what is required is simply some level of aeration, humidity, and temperature control, it is envisioned that simple pits or piles of chips on the ground may be utilized if aeration is provided, as by inserted tubing, and humidity is controlled, if necessary, either by containment or by moisture application.

A particularly suitable laboratory scale reactor is described in FIG. 1. This bioreactor, referred to as the air-lift bioreactor, was fabricated using a polypropylene bucket 20 as the fermentation or reactor vessel. The top of the vessel 20 was sealed with a lid 22 which was vented to the atmosphere through an exit air tube 24. Placed suspended above the bottom of the reactor 20 was a polypropylene perf board, which was a solid disk of polypropylene material vented with air holes. the perf board 26 was suspended in place by a stand 28.

An air filter 30 was provided connected by air tubing 32 to the base of the bioreactor 20. The air filter 30 received its input air supply from a manifold 35 which was supplied, in turn, through an air line 36 connected to the output of a rotameter 38. The rotameter 38 received air from an air line 40 connected to a humidifier 42, which passed incoming air through deionized water in a flask to adjust relevant humidity. Input air was supplied through piping 44 from a regulated air supply.

The air lift reactor 20 thus provided a constant temperature reactor through which constant aeration was provided in a sterile environment. The sterile, humidified air constantly passed through the chip mass. To maintain constant temperature water could be heated to increase the humidity and additional stages of humidification could be added as needed. Air was disbursed to individual reactors from the manifold and passed through a 0.20 micron filter prior to entering the reactor to avoid contamination of other microbial agents.

After mixing the inoculum with the wood chips, the chips were then fermented in the bioreactors at 27° C. plus or minus 1° C. and at 65 plus or minus 5° relative humidity for 2 weeks. Parallel batches were treated both with the solid-phase and liquid-phase starter inoculum along with an untreated control. After harvest both sets of chips were refined in a 300 mm diameter mechanical single disk refiner and paper was made from the pulp thus created.

Prior to making the pulp, the weight loss of the wood chips was measured to provide an indication of the relative digestion of the wood chips by the fungal mycelia from each of the experimental preparations.

The inoculation with the starter inoculant culture and nutrient adjuvant is made to the wood chips to be treated. As discussed above, the amount of inoculum starter culture added to the chips can vary. The inoculant fungal culture can be in liquid or dry form. The inoculum and chips are then mixed and the bioreactors set up as in FIG. 1. The bioreactors are preferably incubated for 4 weeks at 27±1° C. at 65±5% moisture content with constant aeration with moisture-saturated air.

The inoculated chips will then be incubated during a time period in which the fungal mycelia will penetrate throughout the wood chips. The temperature range most desired depends on the fungal strains. It has been found that a bioreactor kept in the range of 22°–32° C. with a moisture content in the wood of 55%–65% plus or minus 5% achieves a degree of mycelia penetration of the wood chips that results in significant and useful degradation of the chips for paper pulping purposes. The wood chips are preferably aerated continually during the incubation period with moisture-saturated air such that the wood maintains the constant moisture content of about 55%–65%. It is most desired that the pH of the chip incubation culture be specifically monitored so that the pH stays within the broad range of between 3.0 and 6.0. Thus it is not required that pH be specifically controlled, but only monitored on occasion so that it remains within the physiological limits necessary for the growth of the fungal culture.

5. Processing the Inoculated Chips

The biologically degraded wood is then pulped. Many pulping methods are suitable for the present invention although mechanical pulping is preferred.

In its simplest form, a mechanical refining process is utilized. Dilution water is added to the chips and the chips are run through a mechanical refiner in a number of sequential passes. The number of passes of the chips/pulp mixture will depend upon the freeness desired for the particular paper application to be made. Freeness is an arbitrary measure of water drainage. The chip/pulp mixture is repeatedly fed through the refiner until the desired level of freeness is achieved. Thus freeness may be periodically monitored to determine the progress of the pulps toward the freeness level which is desired for the paper. The wood pulp may be dewatered as necessary between passes. Loblolly pine, which has been incubated for a time period of four weeks with the procedures described above, requires between ten and fifteen passes to obtain the value of 100 ml Canadian standard freeness in a single disk mechanical refiner with an initial setting of 18 mils.

The overall energy efficiency of the process can be compared with that of a straight mechanical process by pulping in the same apparatus either untreated chips or treated chips while at the same time monitoring the energy consumption of the refining mill itself. The treated chips require significantly less energy input through the refiner to achieve the same level of freeness in the resulting pulps.

The biomechanical pulps made through this procedure may then be made into paper using standard papermaking techniques. Standard techniques (as described by the Technical Association of the Pulp and Paper Industry, TAPPI), which are known to work with mechanically refined pulps, work equally well with biomechanically refined pulps of the type created by the process described herein. Accordingly, the paper may be formed by conventional methods.

Paper made from the biomechanically created pulp can be compared in quality, strength and texture to that created through simple mechanical pulping. The biomechanically created pulp has significantly increased strength property. Thus, it is apparent that the process of the present invention does not sacrifice the quality or strength of the paper in order to achieve the highly desirable energy savings, but, in fact, results in a unique combination of both significant reduction in energy utilization in the process and an increase in the strength properties of the resulting paper.

The details of the process of the present invention will become more apparent from the following Examples which describe the laboratory-scale utilization of the present process and the results achieved thereby. It is understood that the scale-up from a laboratory-scale to a plant-scale process of the pulping operation described below may involve some alteration of the parameters or details of the process steps described herein. It is to be understood that the Examples described below, while they demonstrate the efficacy and practicability of the process of the present invention, have not been optimized for a commercial scale.

Nevertheless, the experimental evidence presented makes it clear that the procedure is efficacious and efficient and enables the creation of commercial scale-procedures for implementing the general process described herein.

EXAMPLES

Example 1

Objective: To determine the optimal fungal inoculum level for saving electrical energy and improving paper strength properties.

Wood chips: Freshly cut Loblolly pine (*Pinus taeda L.*) pulpwood-size logs were obtained from the Talladega National Forest in Talladega, Ala. The logs were debarked and chipped to an average size of 16-mm. The chips were bagged in plastic bags and frozen until used to prevent the growth of contaminating microorganisms.

Fungus: The biopulping fungus *Ceriporiopsis subvermispora* strain CZ-3 was used. This culture was obtained from the Center for Forest Mycology Research of the USDA Forest Products Laboratory, Madison, Wis. The culture was continuously maintained in cereal culture and potato dextrose agar slants. Working cultures were prepared from the stock cultures as needed and refrigerated until used. Potato dextrose agar plate culture was inoculated from a working culture and incubated at 27° C. and 65% relative humidity for 10 days.

In preparing liquid inoculum, potato dextrose broth (50.4 g) and yeast extract (15.28 g) were added to 2100 ml of distilled water and mixed well. 300 ml of this medium was poured into seven 2800 ml flasks. Each flask was autoclaved for 20 min. at 121° C. After cooling to room temperature, each flask was inoculated with 30 plugs cut with a number 9 size cork bore from a 10-day old potato dextrose agar plate of the fungal culture. The flasks were then incubated at 27° C. at 65% relative humidity for 10 days. Prior to use, the flasks containing the fungal biomass were decanted and washed with sterile distilled water to remove excess medium from the fungal biomass. The fungal biomass was then placed in distilled water and blended in a Waring blender (VWR scientific) twice for 15 seconds each time at high speed, following which distilled water was added to the suspension to make the total volume 700 ml.

About 100 grams of this suspension produced 1.50 g dry weight of the fungus. Different dilutions of fungal inoculum were made from the fungal stock solution to obtain 0.01%, 0.05%, 0.10%, 0.15%, and 0.30% inoculum on a dry weight basis, and the appropriate amount of fungal inoculum was diluted to a 100 ml suspension with sterilized water.

Chips preparation and bioreactor inoculation: Frozen loblolly pine chips were thawed and thoroughly mixed to obtain uniform samples. Six static-bed bioreactors (FIG. 1) each containing 1500 g of chips (on a dry weight basis) were autoclaved for 90 min. at 121° C. and then cooled to room temperature.

These bioreactors were inoculated with different levels of inoculum as mentioned above. The full 100 ml of fungal culture was used as the inoculant. One noninoculated bioreactor served as control. About 55% moisture (wet weight basis) in wood chips was maintained during fermentation. After receiving inocula, the bioreactors were shaken vigorously for uniform mixing.

Each bioreactor was sealed and placed in an incubator at 27° C. for 2 weeks and aerated with a specific aeration rate of 0.0227 liter/liter/min. At harvest, fungus-treated chips and control chips were refined in a 300 mm diameter mechanical atmospheric disk refiner to measure energy consumption during refining and the resulting pulp was made into paper and tested for strength properties.

Results: Table 1 describes the results. The lowest amount of inoculum (0.01% on a dry weight basis) only saved 4% of electrical energy during refining and did not improve paper strength compared to the control. The highest amount of inoculum (0.30% on a dry weight basis) saved 19% of electrical energy and improved only tear index significantly (28%) compared to the control.

TABLE 1

Energy savings and strength properties during biomechanical pulping of loblolly pine chips with *Ceriporiopsis subvermispora* CZ-3 (2-week incubation).

| Treatments | | Strength properties | |
|---|---|---|---|
| (% inoculum on dry weight basis) | Energy savings (%)[a] | Burst index (kN/g) | Tear index ($mNm^2/g$) |
| Control | — | .62 ± .05[b] | 1.67 ± .13 |
| .01 | 4 | .63 ± .04 | 1.89 ± .09 |
| .05 | 11 | .71 ± .04 | 2.16 ± .20 |
| .10 | 12 | .74 ± .03 | 2.13 ± .14 |
| .15 | 12 | .70 ± .06 | 2.04 ± .15 |
| .30 | 19 | .70 ± .05 | 2.14 ± .15 |

[a]Energy savings are calculated based on the untreated control values
[b]Standard Deviation

Example 2

The above results are acceptable, but the amount of inoculum (0.3% on a dry weight basis) needed to achieve the results is quite high. Therefore, we attempted to reduce the amount of fungal inoculum to the level of commercial application (0.0005% on a dry weight basis) with the use of specific nutrient adjuvants without sacrificing energy savings or strength improvements.

Objective: To reduce the amount of fungal inoculum.

Wood: As in Example 1

Fungus: The inoculum was prepared as in Example 1. Three different levels of inoculum were used (0.002%, 0.001%, and 0.0005% on a dry weight basis). 210 g of semi-solid corn steep liquor was autoclaved in a beaker for 20 min. at 121° C. 15 or 45 g of semi-solid corn steep liquor was added to different levels of inoculum. These inocula containing corn steep liquor were used to inoculate wood chips contained in the bioreactors. Therefore, 1% or 3% corn steep liquor on a dry wood basis was added to each bioreactor.

Chips preparation and bioreactor inoculation: Same as in Example 1. In this experiment, bioreactors each containing 1500 g of chips (dry weight basis) were steam sterilized for approximately 10 min. instead of autoclaving because this method of sterilization using atmospheric steaming seems practical and is economically feasible. Two bioreactors without the biopulping fungus, one without the corn steep liquor and the other with 1% corn steep liquor, served as controls to see whether corn steep liquor alone has any beneficial or detrimental effect. Similarly another bioreactor was added in the experiment with the reduced amount of inoculum (0.0005% on a dry weight basis), but without the corn steep liquor, to see whether reduced level of inoculum itself can do biopulping.

Results: Table 2 reports the results. The addition of 1% corn steep liquor to the control bioreactor did not save any energy or improve paper strength compared to the control bioreactor without the corn steep liquor. Addition of 1% or 3% corn steep liquor to all the inocula saved 1–19% or 25–30% of electrical energy, respectively, compared to the control. However, overall strength properties due to these treatments were not significantly improved. The reduced amount of inoculum (0.0005% on a dry weight basis) without 1% corn steep did not show any colonization of wood chips. The following conclusions can be drawn from this experiment:

1. Corn steep liquor itself is inert.

2. Reduced amount of inoculum (0.0005% on a dry weight basis) without the corn steep liquor was not successful.

3. Addition of 1% corn steep liquor to 0.0005% inoculum gave about the same amount of energy savings as did the 0.3% inoculum without nutrient adjuvant (Table 1). However, the reduced inoculant plus adjuvant did not improve tear index as did the 0.3% inoculum in the previous experiment (Example 1).

4. 3% corn steep liquor gave more energy savings than 1% corn steep liquor.

Therefore, another experiment (Example 3) was conducted to determine whether high concentration of corn steep liquor (3%) produced more fungal biomass during fermentation and resulted in better biopulping performance of the fungus.

TABLE 2

Energy savings and strength properties during biomechanical pulping of loblolly pine chips with three levels of inoculum of *Ceriporiopsis subvermispora* CZ-3 in the presence of two levels of corn steep liquor (CSL) from Corn Products (batch E802) (2-week incubation).

| Treatments | | Strength properties | |
|---|---|---|---|
| (% inoculum or CSL on dry weight basis) | Energy savings (%)[a] | Burst index (kN/g) | Tear index ($mNm^2/g$) |
| Control - CSL | — | .65 ± .03[b] | 2.12 ± .20 |
| Control + 1% CSL | — | .67 ± .02 | 2.07 ± .10 |
| .002% inoculum + 1% CSL | 18 | .72 ± .05 | 2.17 ± .12 |
| .001% inoculum + 1% CSL | 19 | .71 ± .05 | 2.35 ± .17 |
| .0005% inoculum + 1% CSL | 18 | .74 ± .04 | 2.15 ± .11 |
| .0005% inoculum – 1% CSL[c] | | | |
| .002% inoculum + 3% CSL | 30 | .76 ± .04 | 2.37 ± .13 |
| .001% inoculum + 3% CSL | 25 | .74 ± .04 | 2.18 ± .12 |
| .0005% inoculum + 3% CSL | 25 | .82 ± .06 | 2.27 ± .15 |

[a]Energy savings are calculated based on the untreated control values
[b]Standard Deviation
[c]Fungus did not grow Example 3

Objective: To study the effect of two levels of corn steep liquor on fungal biomass in liquid medium.

Dry weight determination: We maintained 55% moisture in wood on a wet weight basis during fermentation. For example, the 1500 g wood chips (dry weight basis) in a bioreactor have 1833 g of water added. Therefore, to duplicate the bioreactor's moisture content in a flask, 1833 g of water was added to each 2800 ml flask (total of six flasks). 15 or 45 gram of semi-solid corn steep liquor was added to each flask. Therefore, there were three replicates per treatment.

Each flask was covered with the aluminum foil. These flasks were autoclaved for 20 min. at 121° C. Inoculum was prepared as described in Example 1. The 0.0005% inoculum as used in the bioreactor was added to each flask. These flasks were incubated for 14 days at 27° C.

At harvest, the flasks containing the fungal biomass were decanted and washed with sterile distilled water to remove excess medium from the fungal biomass. Replicates were mixed and fungal biomass was dried overnight in an oven set at 105° C. 15 g corn steep liquor (1%) produced 410 mg dry weight of fungus/flask at harvest, whereas 45 g corn steep liquor (3%) at harvest produced 1060 mg dry weight of fungus/flask (Table 3). These results suggest that a high amount of corn steep liquor increased fungal biomass during fermentation and, therefore, resulted in increased biopulping efficacy of the fungus.

TABLE 3

Dry weight of CZ-3 strain of *Ceriporiopsis subvermispora* on sterilized corn steep liquor (CSL) (2-week incubation).

| Treatments | Dry weight of fungus (mg/flask) |
|---|---|
| 1% CSL (dry wt. basis) | 410 |
| 3% CSL (dry wt. basis) | 1060 |

Because 1% sterilized corn steep liquor and reduced amount of fungal inoculum (0.0005% on a dry weight basis) gave good results, we decided to use this combination in the following experiments. Because the addition of corn steep liquor to control wood chips did not affect our results, no corn steep liquor was added to the control in the subsequent experiments.

Example 4

Objective: To compare haploid strains with that of the best diploid strain of *Ceriporiopsis subvermispora* (CZ-3).

Wood: As in Example 1

Fungus: Strain CZ-3 of *Ceriporiopsis subvermispora* gave us good energy savings, but no strength improvements with the use of 1% corn steep liquor and 0.0005% inoculum. This strain was a diploid. In order to save energy and improve paper strength, we started screening haploid strains (single basidiospore isolates) of *Ceriporiopsis subvermispora*. Five different haploid strains (FP-105752 SS-4, L-14807 SS-1, L-14807 SS-3, L-14807 SS-S, L-14807 SS-10) were obtained from the Center for Forest Mycology Research, USDA Forest Products Laboratory, Madison, Wis. Inoculum was prepared the same way as described in Example 1. The biopulping performance of these haploid strains was compared with that of diploid CZ-3 strain.

Chips preparation and bioreactor inoculation: Same as in Example 1, except that the bioreactors containing wood chips were sterilized with atmospheric steaming for 10 min. or so.

Results: Table 4 reports the results. Diploid strain of *Ceriporiopsis subvermispora* (CZ-3) saved 15% of electrical energy and improved tear index by 14% compared to the control. All haploid strains performed better than the diploid strain. Two haploid strains. L14807 SS-3 and L-14807 SS-5 saved 28–29% electrical energy and increased tear index by 21–22% compared to the control.

TABLE 4

Energy savings and strength properties during biomechanical pulping of loblolly pine chips using .0005% inoculum (dry weight basis) of diploid (CZ-3) and haploid strains of *Ceriporiopsis subvermispora* in the presence of 1% corn steep liquor from Corn Products (batch E802) (2-week incubation).

| Treatments | Energy savings (%)[a] | Strength properties: Burst index (kN/g) | Strength properties: Tear index ($mNm^2/g$) |
|---|---|---|---|
| Control | — | .69 ± .05[b] | 2.07 ± .13 |
| CZ-3 | 15 | .67 ± .05 | 2.37 ± .09 |
| FP-105752 SS-4 | 22 | .68 ± .07 | 2.36 ± .13 |
| L-14807-SS-1 | 18 | .65 ± .05 | 2.35 ± .13 |
| L-14807-SS-3 | 29 | .67 ± .06 | 2.50 ± .17 |
| L-14807-SS-5 | 28 | .63 ± .04 | 2.53 ± .12 |
| L-14807-SS-10 | 22 | .68 ± .05 | 2.29 ± .13 |

[a]Energy savings are calculated based on the untreated control values
[b]Standard Deviation These results demonstrate the following:

1. With the use of corn steep liquor and a reduced amount of fungal inoculum, both diploid and haploid strains saved energy and improved paper strength.

2. Two haploid strains gave more energy savings and strength improvement than the diploid strain.

Example 5

Objective: To evaluate the biopulping performance of haploid strain of *Ceriporiopsis subvermispora* (L-14807 SS3) on aspen wood chips in the presence of sterilized and unsterilized corn steep liquor.

Wood chips: The aspen wood chips were obtained from aspen logs harvested in the Nicolet National Forest of Wisconsin. Other details are the same as described in Example 1.

Fungus: The details about inoculum preparation have been described in Example 1. A 0.0005% inoculum (dry weight basis) with 1% (dry wood basis) sterilized or unsterilized corn steep liquor was used.

Chips preparation and bioreactor inoculation: In this experiment wood chips were steamed for 10 min. or so for sterilization. One set of bioreactors was incubated for 2 weeks while the other was incubated for 4 weeks at 27° C. Other details have been described in Example 1.

Results: Table 5 reports our results. In the absence of corn steep liquor, fungus did not grow well enough during this dwell time to achieve significant energy savings, as a result consistent with the previous experiment (Example 2). The difference between the addition of sterilized or unsterilized corn steep liquor, compared to the control chips, did not affect the values for energy and strength properties. Fungal pretreatment in the presence of sterilized or unsterilized corn steep liquor saved the same amount of energy in two weeks (13–15%) and in 4 weeks (35–37%) compared to the control. In two weeks, strength properties were not improved regardless of the type of corn steep liquor used. However, in 4 weeks, sterilized and unsterilized corn steep liquor improved burst index by 21–23%, and tear index by 46–48% compared to the control. These results clearly show that unsterilized corn steep liquor can be used during commercial application and, therefore, biopulping process becomes more cost-effective since sterilization is not required.

TABLE 5

Energy savings and strength properties during biomechanical pulping of aspen wood chips using .0005% inoculum (dry weight basis) of L-14803 SS-3 haploid strain of *Ceriporiopsis subvermispora* (Treatment) in the presence of sterilized and unsterilized 1% corn steep liquor (CSL) from Corn Products (batch E802) (2- and 4-week incubation).

| Treatments | Energy savings (%)[a] | Strength properties: Burst index (kN/g) | Strength properties: Tear index ($mNm^2/g$) |
|---|---|---|---|
| 2-week incubation | | | |
| Control | — | 1.01 ± .05[b] | 2.16 ± .20 |
| Treatment (sterilized CSL) | 15 | 1.11 ± .07 | 2.49 ± .16 |
| Treatment (unsterilized CSL) | 13 | 1.11 ± .04 | 2.37 ± .23 |
| 4-week incubation | | | |
| Control | — | 1.08 ± .04 | 2.14 ± .12 |
| Treatment (sterilized CSL) | 35 | 1.33 ± .05 | 3.13 ± .20 |
| Treatment (unsterilized CSL) | 37 | 1.31 ± .07 | 3.16 ± .14 |

[a]Energy savings are calculated based on the untreated control values
[b]Standard Deviation

Example 6

Objective: To evaluate the biopulping performance of haploid strain of *Ceriporiopsis subvermispora* (L-14807 SS-3) on loblolly pine chips in the presence of unsterilized corn steep liquor.

Wood chips: Details same as in Example 1

Fungus: The details about inoculum preparation have been described in Example 1. A 0.0005% inoculum (dry weight basis) with 1% (dry wood basis) unsterilized corn steep liquor was used.

Chips preparation and bioreactor inoculation: In this experiment wood chips were steamed for 10 min. or so for sterilization. Control and the inoculated bioreactors were incubated for 2 weeks at 27° C. Other details have been described in Example 1.

Results: Table 6 reports the results. Fungal pretreatment saved a substantial amount of energy (38%) and improved tear index by 51% compared to the control. Addition of sterilized 1% corn steep liquor saved 29% electrical energy and improved tear index by 21% compared to the control (Table 4). These results show that the use of unsterilized corn steep liquor compared to the sterilized corn steep liquor (Example 4) enhanced the biopulping efficacy of haploid strain of the fungus. In a previous experiment (Example 3), enhanced biopulping efficacy was attributed to more fungal biomass in the liquid medium due to increased quantity of corn steep liquor (3% on a dry wood basis). To establish the same relationship between the fungal biomass in the liquid medium and the biopulping efficacy of the fungus in a bioreactor, we determined the effect of unsterilized and sterilized corn steep liquor on the fungal biomass in the liquid medium.

TABLE 6

Energy savings and strength properties during biomechanical pulping of loblolly pine chips using .0005% inoculum (dry weight basis) of L-14803 SS-3 haploid strain of *Ceriporiopsis subvermispora* (Treatment) in the presence of unsterilized 1% corn steep liquor from Corn Products (batch E802) (2-week incubation).

| Treatments | Energy savings (%)[a] | Strength properties | |
|---|---|---|---|
| | | Burst index (kN/g) | Tear index ($mNm^2/g$) |
| Control | — | .61 ± .05[b] | 1.81 ± .12 |
| Treatment | 38 | .70 ± .04 | 2.73 ± .14 |

[a]Energy savings are calculated based on the untreated control values
[b]Standard Deviation Example 7

Objective: To compare the effect of sterilized corn steep liquor with that of unsterilized corn steep liquor on fungal biomass in liquid medium.

Dry weight determination: 1833 g of water was added to each 2800 ml flask (total flasks four). 30 g of corn steep liquor was added to two of these flasks each containing 15 g of corn steep liquor. Each flask was covered with the aluminum foil. All of these flasks were autoclaved for 20 min. at 121° C. 30 g of unsterilized corn steep liquor was added to the remaining two flasks each containing 1833 g of sterilized water. Inoculum was prepared as described in Example 1. A 0.0005% inoculum as used in the bioreactor was added to each flask.

These flasks were incubated for 14 days at 27° C. At harvest, the flasks containing the fungal biomass were decanted and washed with sterile distilled water to remove excess medium from the fungal biomass. Replicates were mixed and fungal biomass was dried overnight in an oven set at 105° C.

Results: Table 7 records the results. Sterilized corn steep liquor at harvest produced 425 mg dry weight of fungus/flask, whereas unsterilized corn steep liquor at harvest produced only 190 mg dry weight of fungus/flask, These results indicate that a combination of unsterilized corn steep liquor and steamed wood might be responsible for the enhanced biopulping efficacy of the haploid strain of the fungus. Since in the above experiment, unsterilized corn steep liquor produced substantially less fungal biomass than the sterilized corn steep liquor in the liquid medium, we decided to study the effect of other chemicals (sterilized and unsterilized) on fungal biomass in liquid culture first and subsequently on the biopulping performance of the haploid strain (L-14807 SS-3) of the fungus using unsterilized chemicals.

TABLE 7

Dry weight of L-14807 SS-3 haploid strain of *Ceriporiopsis subvermispora* on sterilized and unsterilized corn steep liquor (CSL) (2-week incubation).

| Treatments | Dry weight of fungus (mg/flask) |
|---|---|
| Sterilized CSL | 425 |
| Unsterilized CSL | 190 |

Example 8

Objective: To study the effect of sterilized and unsterilized yeast extract and molasses on fungal biomass in liquid medium.

Dry weight determination: Same as in Example 7. 15 g of each nutrient adjutant was used.

Results: Table 8 reports our results. Sterilized yeast extract at harvest produced 305 mg dry weight of fungus/flask, whereas unsterilized yeast extract did not allow the fungus to grow. On the other hand, sterilized molasses at harvest produced 365 mg dry weight of fungus/flask and unsterilized molasses at harvest produced 230 mg dry weight of fungus/flask.

TABLE 8

Dry weight of L-14807 SS-3 haploid strain of *Ceriporiopsis subvermispora* on sterilized and unsterilized yeast extract and molasses (2-week incubation).

| Treatments | Dry weight of fungus (mg/flask) |
|---|---|
| Yeast extract | |
| Sterilized | 305 |
| Unsterilized | 0 |
| Molasses | |
| Sterilized | 365 |
| Unsterilized | 230 |

Example 9

Objective: To determine the biopulping efficacy of haploid isolate of *Ceriporiopsis subvermispora* (L-14807 SS-3) using unsterilized yeast extract and molasses.

Wood: Same as in Example 1

Fungus: 0.0005% fungal inoculum of L-14807 SS-3 haploid strain was used. Corn steep liquor used in the previous studies is a semi-solid liquid (about 50% solid). Addition of 15 g of corn steep liquor to each bioreactor containing 1500 g dry weight of chips amounts to 1% corn steep liquor (semi-solid corn steep liquor/dry weight of wood). Because corn steep liquor has about 50% solid content, we used 0.5% corn steep liquor (dry weight of corn steep liquor/dry weight of wood) in previous experiments. Yeast extract and molasses were also used at the same rate of 0.5% (dry weight of chemical/dry weight of wood) in this experiment. Yeast extract is a dried powder, whereas molasses has about 62% solid content. Therefore, 7.5 g of yeast extract and 12 g of molasses were added to the inoculum in order to have the same dry weight of each chemical per bioreactor as was the case for corn steep liquor. Other details are the same as in Example 1.

Chips preparation and bioreactor inoculation: In this experiment wood chips were steamed for 10 min. or so for sterilization. Control and the inoculated bioreactors were incubated for 2 weeks at 27° C. Other details have been described in Example 1.

Results: Table 9 reports the results. Unsterilized yeast extract and molasses saved 14 and 20% electrical energy, respectively, and increased tear index by 21 and 33%, respectively compared to the control. These results show that unsterilized yeast extract and molasses can also be used in biopulping but these non-chemically defined media are not as effective as corn steep liquor.

TABLE 9

Energy savings and strength properties during biomechanical pulping of loblolly pine chips using .0005% inoculum (dry weight basis) of haploid strain (L-14807 SS-3) of *Ceriporiopsis subvermispora* in the presence of unsterilized 0.5% yeast extract and molasses on a dry weight basis (2-week incubation).

| Treatments | Energy savings (%)[a] | Strength properties: Burst index (kN/g) | Strength properties: Tear index ($mNm^2/g$) |
|---|---|---|---|
| Control | — | .55 ± .03[b] | 1.81 ± .10 |
| Yeast extract | 14 | .59 ± .03 | 2.28 ± .08 |
| Molasses | 20 | .65 ± .06 | 2.41 ± .13 |

[a]Energy savings are calculated based on the untreated control values
[b]Standard Deviation

We claim:

1. A method of making a wood pulp comprising the steps of:

(a) chipping wood into wood chips;

(b) inoculating the wood chips with a liquid inoculum of *Ceriporiopsis subvermispora* and corn steep liquor;

(c) introducing the wood chips into a bioreactor, wherein step (c) may take place before or after step (b);

(d) incubating the wood chips under conditions favoring the propagation of the fungus through the wood chips for a sufficient amount of time for the fungus to modify a significant amount of the lignin naturally present in the wood chips; and (e) mechanically pulping the wood chips degraded by the fungus into a paper pulp.

2. The method of claim 1 wherein the wood chips are obtained from southern yellow pine.

3. The method of claim 1 wherein the wood chips are aspen.

4. The method of claim 1 wherein the amount of corn steep liquor is between 0.5% and 3% on a dry weight basis.

5. The method of claim 1 wherein the amount of corn steep liquor is 1% on a weight to weight (liquid to dry) basis.

6. The method of claim 5 wherein the corn steep liquor has properties of about the following values:

| | |
|---|---|
| Dry substance (%) | 50.7, |
| pH | 3.9, |
| Protein (% dry basis) | 40.8, |
| Lactic acid (% dry basis) | 16.0, and |
| Reducing sugars (% dry basis) | 12.8. |

7. The method of claim 1 wherein the inoculum is less than 0.3% on a dry weight basis.

8. The method of claim 1 wherein the inoculum is less than 0.1% on a dry weight basis.

9. The method of claim 1 wherein the inoculum is less than 0.01% on a dry weight basis.

10. The method of claim 1 wherein the inoculum is equal to or less than 0.0005% on a dry weight basis.

11. The method of claim 1 wherein step (d) is conducted for about two weeks.

12. A method of pretreating wood so that the wood may be made into pulp more efficiently comprising the steps of:

(a) chipping the wood into wood chips, and (b) inoculating the wood chips with a liquid inoculant of *Ceriporiopsis subvermispora* and corn steep liquor.

13. A method for producing paper comprising the steps of:

(a) inoculating wood chips with a liquid inoculant of *Ceriporiopsis subvermispora* and unsterilized corn steep liquor;

(b) introducing the wood chips into a bioreactor; wherein step (b) may take place before or after step (a);

(c) incubating the wood chips under conditions favorable to the propagation of the fungus through the wood chips;

(d) pulping the incubated wood chips to a selected level of freeness of fibers in the pulp; and (e) making papers with the pulp so produced.

* * * * *

UNITED STATES PATENT AND TRADEMARK OFFICE

CERTIFICATE OF CORRECTION

PATENT NO. : 5,620,564

DATED : 04/15/97

INVENTOR(S) : Masood Akhtar

It is certified that error appears in the above-identified patent and that said Letters Patent is hereby corrected as shown below:

In column 1, please insert the following test after the title:

--STATEMENT REGARDING FEDERALLY SPONSORED RESEARCH

This invention was made with U.S. government support awarded by USDA Biopulping Consortium II. The United States Government has certain rights in this invention. --

Signed and Sealed this

Second Day of June, 1998

*Attest:*

*Attesting Officer*

BRUCE LEHMAN

*Commissioner of Patents and Trademarks*